US006773082B2

(12) United States Patent
Lee

(10) Patent No.: US 6,773,082 B2
(45) Date of Patent: Aug. 10, 2004

(54) REFRIGERATOR USING EPS INSULATING MATERIAL

(75) Inventor: Jung Owan Lee, Seoul (KR)

(73) Assignee: Daewoo Electronics Corp. (KR)

( * ) Notice: Subject to any disclaimer, the term of this patent is extended or adjusted under 35 U.S.C. 154(b) by 79 days.

(21) Appl. No.: 10/061,065

(22) Filed: Jan. 28, 2002

(65) Prior Publication Data

US 2003/0141793 A1 Jul. 31, 2003

(51) Int. Cl.[7] ..... A47B 96/14
(52) U.S. Cl. ..... 312/401
(58) Field of Search ..... 312/400, 401, 312/406, 406.2, 409, 257.1, 116, 236; 220/592.01, 592.02, 592.09, 592.1; 62/440

(56) References Cited

U.S. PATENT DOCUMENTS 3,440,308 A * 4/1969 Carbary et al. ..... 264/45.3
3,697,723 A * 10/1972 Winsler et al. ..... 312/236
3,802,591 A * 4/1974 Mizushima et al. ..... 220/592.1
4,586,348 A * 5/1986 Nakayama et al. ..... 62/277
4,706,363 A * 11/1987 Taylor, Jr. ..... 312/257.1 X
4,822,117 A * 4/1989 Boston, Jr. ..... 312/257.1
4,903,858 A * 2/1990 Clark et al. ..... 220/592.02
5,000,010 A * 3/1991 Powell et al. ..... 312/401 X
5,435,142 A * 7/1995 Silber ..... 62/372 X
5,730,516 A * 3/1998 Vismara ..... 312/401 X
5,897,181 A * 4/1999 Avendano et al. ..... 312/401

FOREIGN PATENT DOCUMENTS

DE 2135724 * 2/1972
WO WO 99/13280 * 3/1999

OTHER PUBLICATIONS

Home Energy Magazine Online—"Energy Efficiency in the European Union", Jan./Feb. 1998, pp. 1–10.*

* cited by examiner

*Primary Examiner*—James O. Hansen
(74) *Attorney, Agent, or Firm*—Anderson Kill & Olick, PC

(57) ABSTRACT

A refrigerator cabinet assembly is disclosed. The refrigerator cabinet assembly has an outer case including two laterally spaced side walls and a top wall interconnecting the two side walls. Each of the side walls and the top wall is provided with front face portions and rear face portions. The structural rigidity of the outer case is increased by a plurality of reinforcing members. The reinforcing members are secured to the outer case by, e.g., self-drilling screws. The refrigerator cabinet assembly is devoid of welded portions.

5 Claims, 4 Drawing Sheets

REFRIGERATOR USING EPS INSULATING MATERIAL

FIELD OF THE INVENTION

The present invention relates to a refrigerator using an expandable polystyrene (EPS) insulating material, and, more specifically, to a refrigerator manufactured by an assembly method in which the need for welding operation is eliminated and an EPS material is used as an insulating material.

BACKGROUND OF THE INVENTION

Household refrigerators generally include an outer cabinet and an inner liner with a foam insulation ember interposed therebetween. Two side walls and a top wall of the outer cabinet are formed out of a single piece of sheet metal. Front edge portions of the side wall and the top wall are bent to form two front side face portions and a top front ace portions, respectively. Thereafter, upper edges of the front side face portions re welded with corresponding edges of the top front face portions. Further, since the outer cabinet is formed from sheet metal or similar generally flexible material, the outer cabinet requires to be reinforced in order to adequately withstand loads exerted thereon during normal use of the refrigerator. Such reinforcing members are welded to the outer cabinet to increase structural rigidity thereof.

The foam insulation member is usually formed out of polyurethane composition material in liquid or gas form. The polyurethane composition material is filled into the space between the outer cabinet and the inner liner, and is then solidified by a curing process to form the foam insulation member. This foam insulation member which adheres to both the outer cabinet a d the inner liner increases structural rigidity of the outer cabinet.

However, when the foam insulation member is formed from the polyurethane composition material, lots of chlorofluorocarbon (CFC) gases are used, which cause environmental pollution such as ozonosphere destruction in stratosphere. In order to prevent such a problem, it is preferable to employ insulating materials such as EPS materials which do not use CFC gases in manufacturing process.

Furthermore, if the outer cabinet is manufactured wholly by an assembly method without welding, the recycling thereof can be facilitated since it can be easily disassembled.

SUMMARY OF THE INVENTION

It is, therefore, an object of the present invention to provide a refrigerator including an outer case manufactured by an assembly method in which the need for welding operation is eliminated and an EPS material is used as an insulating material.

In accordance with an aspect of the present invention, there is provided a refrigerator cabinet assembly including an outer case including two laterally spaced side walls and a top wall interconnecting the two side walls, each of the side walls and the top wall including front face portions and rear face portions, a plurality of reinforcing members for increasing the structural strength of the outer case, and means for securing said plurality of reinforcing members to the outer case, wherein the refrigerator cabinet assembly is devoid of welded portion.

In accordance with an embodiment of the present invention, there is provided a refrigerator including a cabinet assembly including an outer metal case including two laterally spaced side walls and a top wall interconnecting the two side walls, a plurality of reinforcing members for increasing the structural strength of the outer metal case and means for securing said plurality of reinforcing members to the outer metal case, and a plurality of insulating members made of expandable polyethylene, wherein the refrigerator cabinet assembly is devoid of welded portion.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1:
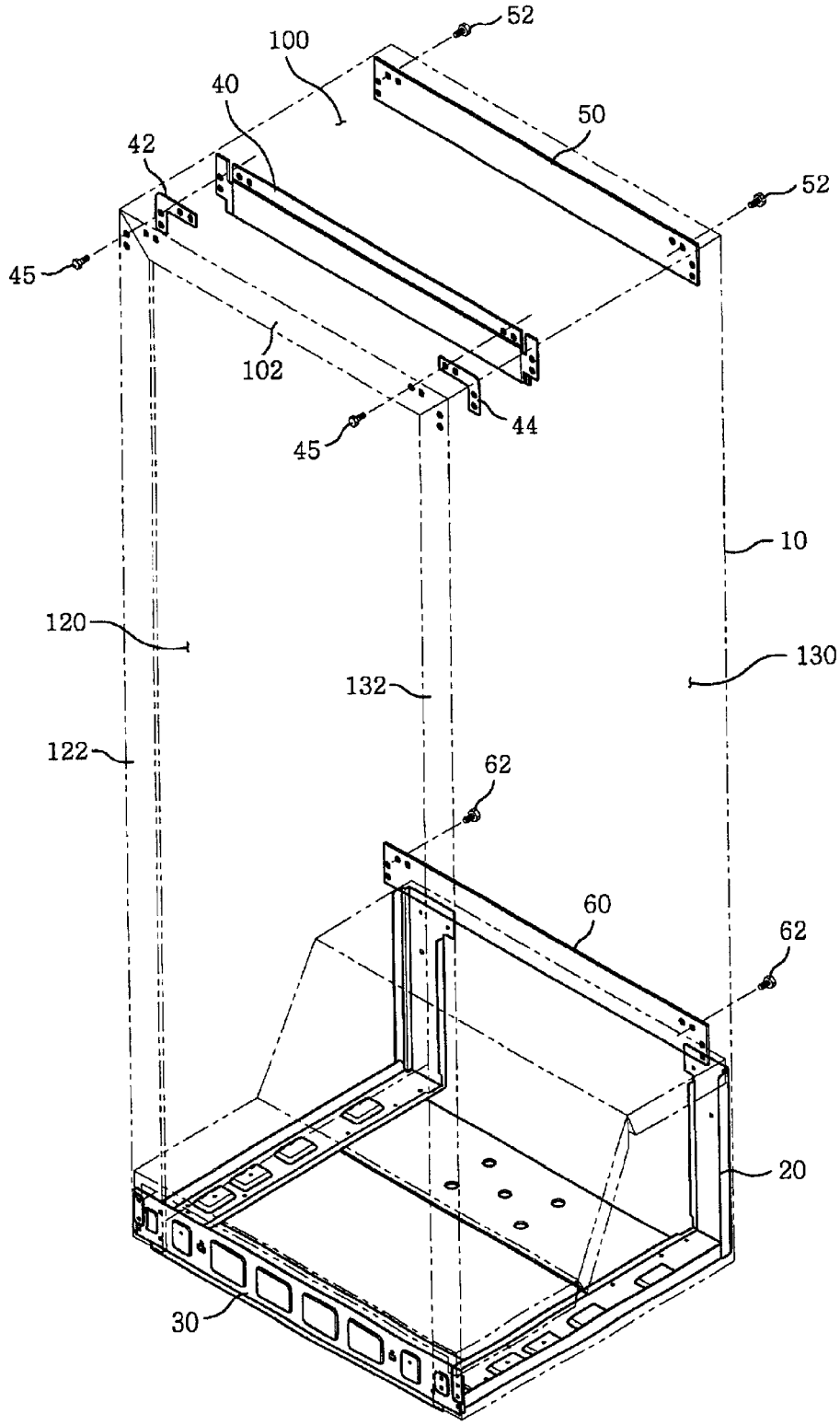
FIG. 1 is a perspective view of a refrigerator cabinet assembly in accordance with the present invention.

FIG. 1 shows a perspective view of a refrigerator cabinet assembly in accordance with the present invention.

The refrigerator cabinet assembly includes an outer case 10 and a plurality of reinforcing members. The outer case 10, which is shown in FIG. 1 by dotted lines, has a top wall 100 and a first and a second side walls 120 and 130. As shown in FIG. 1, the side walls 120 and 130 and the top wall 100 are integrally formed from bending a piece of sheet metal such that the side walls 120 and 130 are arranged in an upstanding, substantially parallel manner and are spaced and interconnected by the top wall 100. Preferably, pre-coated sheet metal may be used to form the outer case. When pre-coated sheet metal is used, cabinet coating process can be eliminated and the time required for assembly of the refrigerator can be decreased.

Front edge portions of the side walls 120 and 130 are bent inwardly so as to define a first an a second front face portions 122 and 132, respectively. Further, rear edge portions of the side walls 120 and 130 are also bent laterally inwardly so as to define first and a second rear face portions 124 and 134, respectively. Front and ear edge portions of the top wall 100 are likewise bent to form a third front face portion 102 and a third rear face portion 104, respectively.

Reference will now be made to FIG. 1 in describing said plurality of reinforcing members.

The upper front reinforcing member 40 has a shape of elongated, rectangular bars. Two side end portions of the upper front reinforcing member 40 are secured to the first and the second front face portions 122 and 132, respectively. Further, top left and right portions of the upper front reinforcing member 40 are secured to the third front face portion 102. Preferably, self-drilling screws 45 are used for securing the upper front reinforcing member 40 to the outer case 10.

Reinforcing brackets 42 and 44 are also provided in order to increase the structural rigidity of the upper left and the right corner portions of the outer case 10. The reinforcing brackets 42 and 44 have a first and a second leg portions which are arranged substantially perpendicular to each other.

The reinforcing brackets 42 and 44 may be secured to the outer case 10 by the same self-drilling screws 45 which are used for securing the upper front reinforcing member 40. In order to align the screw holes of the reinforcing brackets 42 and 44 to those of the upper front reinforcing member 40, protrusions are provided on the upper front reinforcing member 40 and receiving holes for accommodating the protrusions are provided on the reinforcing brackets 2 and 44. In such a configuration, time required for assembly can be decreased since the reinforcing brackets 42 and 44 are properly positioned on the upper front reinforcing member 40 just by matching the protrusions and the receiving holes.

Figure 2:
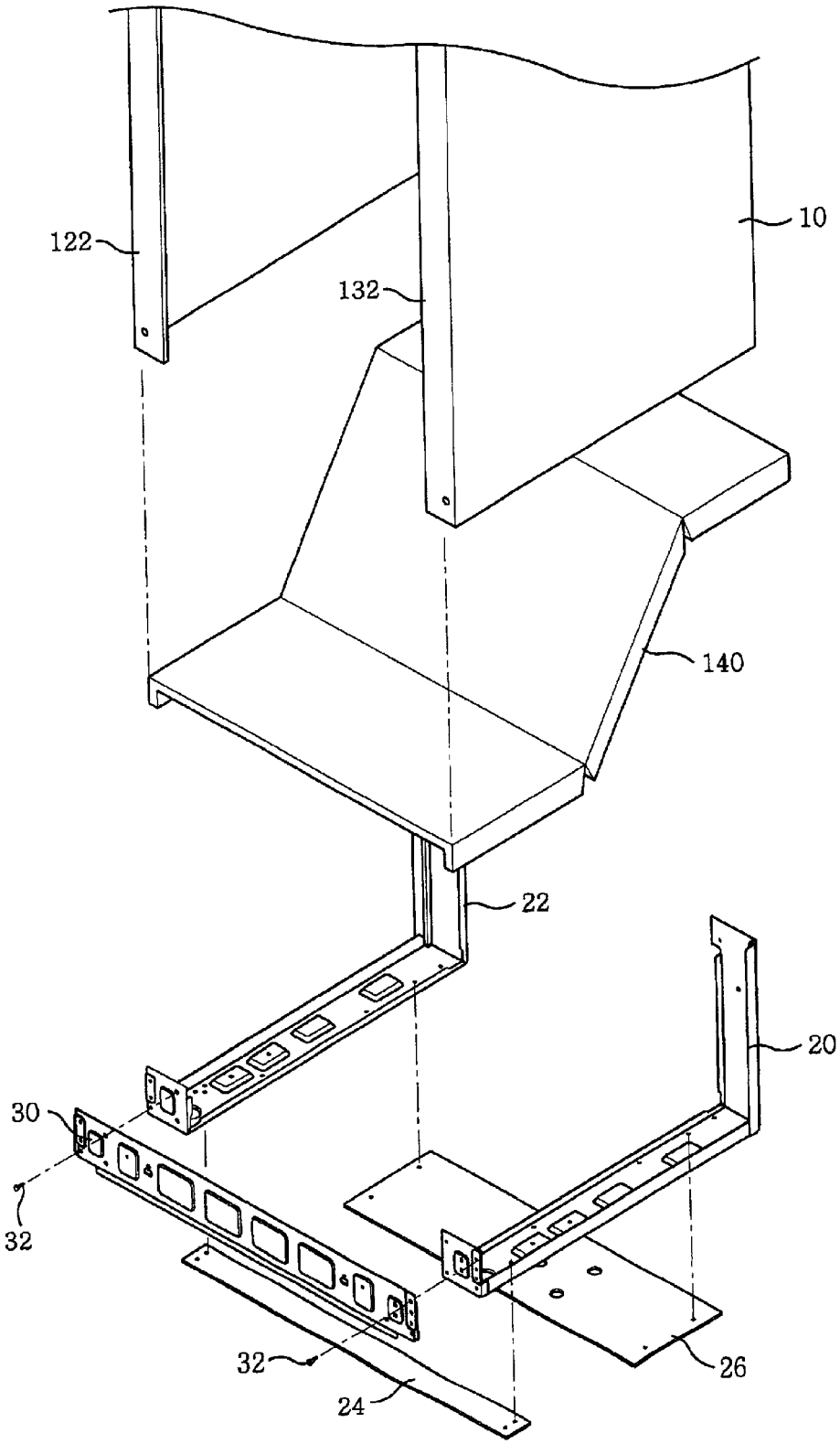
FIG. 2 provides an exploded perspective view of the refrigerator cabinet assembly in FIG. 1, showing the lower portion thereof.

Reference will n be made to FIG. 2 in describing a first and a second lower side reinforcing members 20 and 22 and a lower front reinforcing member 30. Each lower side reinforcing member 20 and 22 is in a U-shape and manufactured out of a relatively thick steel sheet. The lower side reinforcing members 20 and 22 are located along the inner surfaces of the lower edges of the left and the right side walls 120 and 130. Each lower side reinforcing member 20 and 22 is secured by, e.g., self-drilling screws to the first and the second front face portions 122 and 132 and the first and the second rear face portions 124 and 134. The lower front reinforcing member 30 as a shape of elongated rectangular bar. Both side end portions of the lower front reinforcing member 30 are secured to the inner surface of the first and the second front face portions 122 and 132, respectively. Preferably, the lower front reinforcing member 30 is first secured to the side reinforcing members 20 and 22 an then, the lower side reinforcing members 20 and 22 are secured to the outer casing 10. In order to increase the structural rigidity of the refrigerator cabinet, the lower side reinforcing members 20 and 22 are connected by one or more steel plates. For example, a first and a second base plate 24 and 26 can be secured to the lower surfaces of the lower side reinforcing members 20 and 22. On the second base plates 26, a compressor (not shown) prepared for the refrigerating cycle of the refrigerator can be located. The base plates 24 and 26 may also be secured by self-drilling screws. Further, a bottom plate 140 is provided above the lower side reinforcing members 20 and 22. The bottom plate 140 may be secured to the lower side reinforcing members 20 and 22 via blocks (not shown) having a generally C-shaped cross section.

Figure 3:
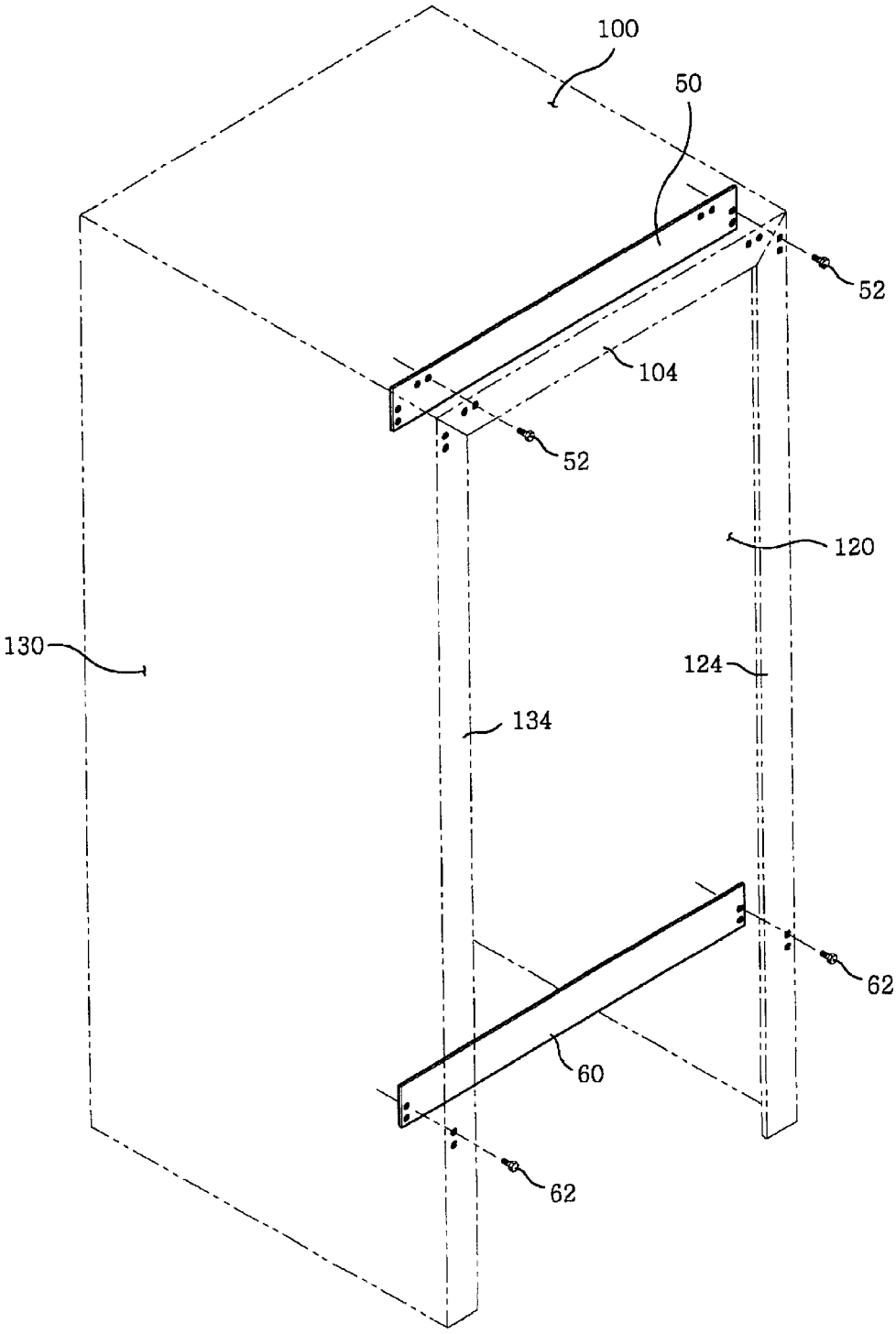
FIG. 3 shows a perspective view of the refrigerator cabinet assembly, showing the rear portion thereof.

Reference will now be made to FIG. 3 in describing an upper and a lower reinforcing member 50 and 60. Each rear reinforcing members 50 and 60 has a shape of elongated rectangular bar. The upper rear reinforcing member 50 is secured to the inner surface of the first and the second rear face portions 124 and 134 by, e.g., self-drilling screws. Likewise, the lower rear reinforcing member 60 is of a shape of elongated rectangular bar and is secured to the first and the second rear face portions 124 and 134. Preferably, the lower rear reinforcing member 60 is secured at the position right above the bottom plate 140. In such a case, the lower rear reinforcing member 60 may be of a bar shape having a generally L-shaped cross section. After the upper and the lower reinforcing members 50 and 60 are secured to the outer case 10, a rear plate (not shown) is fixed to the outer case 10 by screws.

After the assembly of the reinforcing members are finished, decorators may be provided in order to cover the head portions of the screws.

Figure 4:
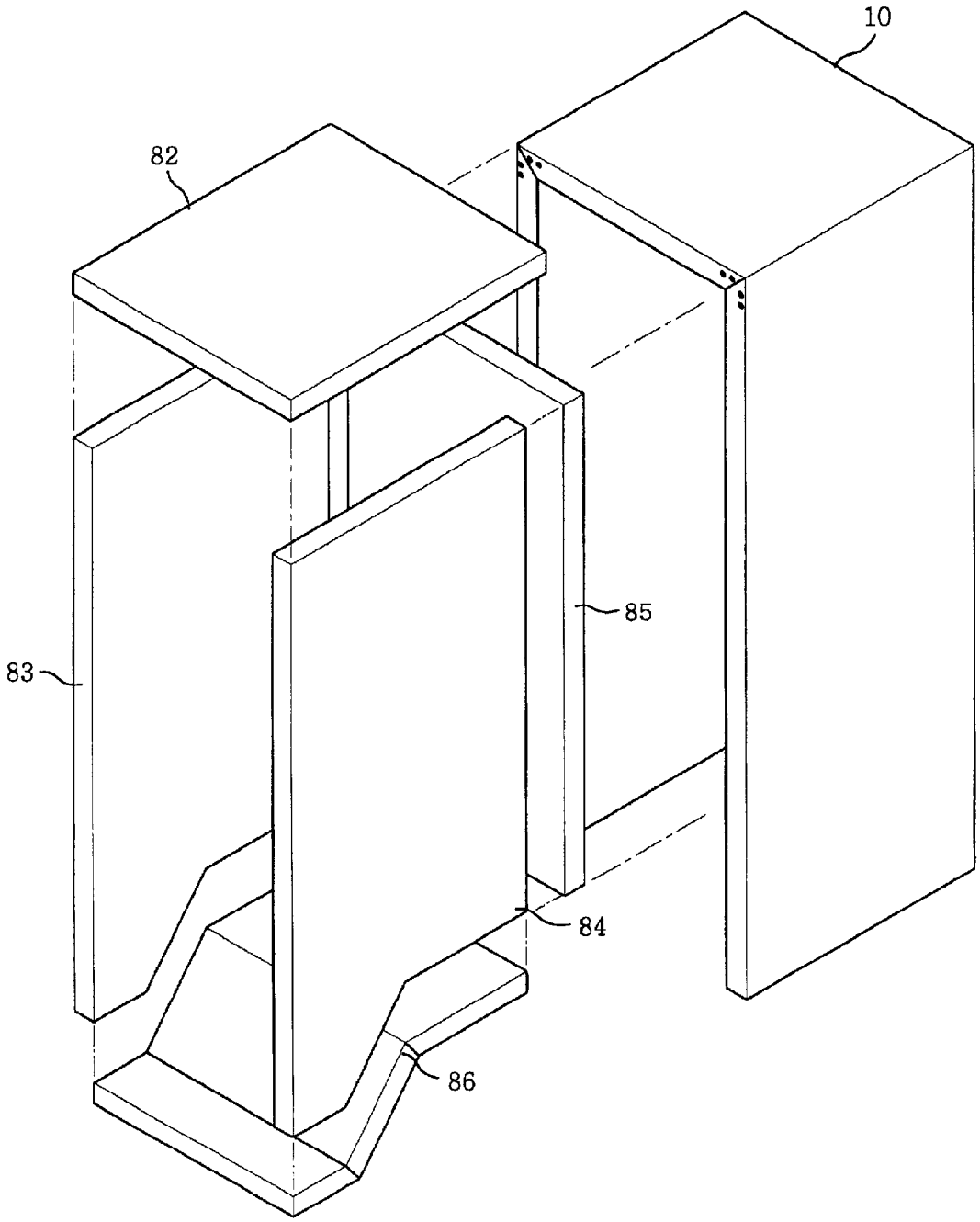
FIG. 4 illustrates an exploded perspective view of the refrigerator cabinet assembly in FIG. 1, showing the EPS insulating materials.

As an insulating material in accordance with the present invention, an EPS material is employed. A plurality of EPS materials are located on the inner surfaces of the top wall 100, two side walls 120 and 130, rear plate and on the bottom plate 140, which are indicated by the reference numerals 82, 83, 84, 85 and 86 in FIG. 4, respectively. The EPS materials are cut into a shape to fit the space between the outer case 10 and the inner liner. The assembly of the EPS material can be performed after all of the reinforcing members are secured to the outer case 10 or during the securing process thereof.

While the present invention has been shown and described with respect to the preferred embodiments, it will be understood by those skilled in the art that various changes and modifications may be made without departing from the spirit and scope of the invention as defined in the following claims.

What is claimed is:

1. A refrigerator cabinet assembly, comprising:

an outer case including two laterally spaced side walls and a top wall interconnecting the two side walls, a front edge portion of each of the side walls being bent inwardly so as to define a first and a second front face portion and a front edge portion of the top wall being bent inwardly so as to define a third front face portion;

an upper front reinforcing member for increasing the structural rigidity of the outer case, the upper front reinforcing member being secured to the first and the second front face portion and the third front face portion;

a lower front reinforcing member for increasing the structural rigidity of the outer case, the lower front reinforcing member being secured to the first and the second front face portion; and means for securing said reinforcing members to the outer case, wherein the refrigerator cabinet assembly is devoid of welded portions, the refrigerator cabinet assembly further comprising a first and a second reinforcing bracket, wherein the first and the second reinforcing bracket are secured to the first and the second front face portion, the first and the second reinforcing bracket being interposed between the first and the second front face portion and the upper reinforcing member.

2. The refrigerator cabinet assembly of claim 1, further comprising a first and a second lower side reinforcing member, wherein a rear edge portion of each of the side walls is bent inwardly so as to define a first and a second rear face portion, and each of the first and the second lower side reinforcing members are secured to the first and the second front face portion and the first and the second rear face portion.

3. The refrigerator cabinet assembly of claim 1, wherein the securing means are self-drilling screws.

4. The refrigerator cabinet assembly of claim 1, wherein the outer case is a pre-coated metal plate.

5. The refrigerator cabinet assembly of claim 1, further comprising A refrigerator cabinet assembly, comprising:

an outer case including two laterally spaced side walls and a top wall interconnecting the two side walls, a front edge portion of each of the side walls being bent inwardly so as to define a first and a second front face portion and a front edge portion of the top wall being bent inwardly so as to define a third front face portion;

an upper front reinforcing member for increasing the structural rigidity of the outer case, the upper front reinforcing member being secured to the first and the second front face portion and the third front face portion;

a lower front reinforcing member for increasing the structural rigidity of the outer case, the lower front reinforcing member being secured to the first and the second front face portion; and means for securing said reinforcing members to the outer case, wherein the refrigerator cabinet assembly is devoid of welded portions, the refrigerator cabinet assembly further comprising an upper and a lower rear reinforcing member, where a rear edge portion of each of the side walls is bent inwardly so as to define a first and a second rear face portion, and each of the upper and the lower rear reinforcing members are secured to the first and the second rear face portion.

* * * * *